US006206263B1

(12) United States Patent
Rich et al.

(10) Patent No.: US 6,206,263 B1
(45) Date of Patent: Mar. 27, 2001

(54) MATERIAL ADVANCE TRACKING SYSTEM

(75) Inventors: Leonard G. Rich, West Hartford; Ronald B. Webster, Ellington; Mark E. Guckin, Middletown, all of CT (US)

(73) Assignee: Gerber Scientific Products, Inc., Manchester, CT (US)

( * ) Notice: Subject to any disclaimer, the term of this patent is extended or adjusted under 35 U.S.C. 154(b) by 0 days.

(21) Appl. No.: 09/311,167

(22) Filed: May 13, 1999

(51) Int. Cl.[7] ..... B65H 23/18; B65H 26/00
(52) U.S. Cl. ..... 226/30; 226/45
(58) Field of Search ..... 226/28, 30, 45

(56) References Cited

U.S. PATENT DOCUMENTS

| | | | | |
|---|---|---|---|---|
| 3,949,856 | * | 4/1976 | Ulber et al. | 226/45 X |
| 4,147,078 | * | 4/1979 | Bishop | 83/74 |
| 5,027,993 | * | 7/1991 | Ferguson | 226/45 X |
| 5,138,341 | | 8/1992 | Kobayashi . | |
| 5,405,069 | * | 4/1995 | Duncan et al. | 226/45 X |
| 5,695,106 | * | 12/1997 | Bauknecht | 226/45 X |
| 5,766,389 | * | 6/1998 | Brandon et al. | 226/30 X |
| 5,930,139 | * | 7/1999 | Chapdelaine et al. | 226/30 X |
| 6,033,502 | * | 3/2000 | Coenen et al. | 226/30 X |

OTHER PUBLICATIONS

U.S. application No. 09/069,392, Rich et al., filed Apr. 29, 1998.

* cited by examiner

*Primary Examiner*—Michael R. Mansen
(74) *Attorney, Agent, or Firm*—McCormick, Paulding & Huber LLP

(57) ABSTRACT

The friction drive system for printing, plotting or cutting graphic images on strip material includes a feedback for a drive motor driving a plurality of friction wheels for advancing strip material in a longitudinal direction. The feedback signal includes a short-term response component and a long-term response component to accurately pinpoint the exact longitudinal location of the strip material. The short-term response component is generated by comparing a motor encoder signal from a motor encoder secured to the drive motor with a commanded longitudinal position of the strip material and passing the resultant differential error signal through an all pass filter. The long-term response component is generated by comparing a detecting encoder signal from a detecting encoder secured to a device detecting the actual longitudinal position of the strip material with the commanded longitudinal position of the strip material and passing the differential error signal through a low pass filter.

22 Claims, 4 Drawing Sheets

MATERIAL ADVANCE TRACKING SYSTEM

BACKGROUND OF THE INVENTION

1. Technical Field

The present invention relates to friction drive systems such as printers, plotters and cutters that feed strip material therethrough for generating graphic images and, more particularly, to friction drive systems which accurately track the longitudinal position of the strip material.

2. Background Art

Friction, grit, or grid drive systems for moving strips or webs of sheet material longitudinally back and forth along a feed path through a plotting, printing, or cutting device are well known in the art. In such drive systems, friction (or grit or grid) wheels are placed on one side of the strip of sheet material (generally vinyl or paper) and pinch rollers, of rubber or other flexible material, are placed on the other side of the strip. Spring pressure urges the pinch rollers and material against the friction wheels. During plotting, printing, or cutting, the strip material is driven by the friction wheels back and forth in the longitudinal or X-coordinate direction in accordance with a commanded position for the strip material. As the strip material is advanced back and forth in the longitudinal direction, a pen, printing head, or cutting blade is driven over the strip material in the lateral or Y-direction.

These systems have gained substantial favor due to their ability to accept plain (unperforated) strips of material in differing widths. However, the existing friction feed systems experience several problems. One problem is that the existing systems do not compare the commanded position of the strip material and the actual position of the strip material. Thus, if a longitudinal slippage or creep error in the X-coordinate direction occurs with the strip material moving either too slowly or too fast, respectively, the system is not aware of the discrepancy between the commanded position and the actual position of the strip material. This potential discrepancy is not detected until the plot is completed and results in inaccurate final work product. This problem is most pronounced in long plots, i.e. those two or more feet in length, and those in which the strip material moves back and forth in the X-coordinate direction with respect to a tool head such as a plotting pen, print head, or cutting blade.

SUMMARY OF THE INVENTION

It is an object of the present invention to ensure that the actual longitudinal position of the strip material is substantially identical to the commanded longitudinal position of the strip material in a friction drive system.

According to the present invention, a friction drive apparatus for feeding strip material in a longitudinal direction along a feed path includes a motor encoder secured to a drive motor that rotates friction wheels for advancing the strip material longitudinally and a detecting means for detecting the longitudinal position of the strip material. The motor encoder generates a motor encoder signal, indicative of the rotational movement of the drive motor and friction wheels. The detecting means generates a detecting encoder signal indicative of the actual longitudinal position of the strip material. The motor encoder signal is compared with the commanded position signal and the difference is filtered and defined as a filtered motor encoder position error signal or a short-term error signal component. The detecting encoder signal is also compared to the commanded position of the strip material with the difference filtered to remove high frequencies to result in a filtered detecting encoder position error signal or a long-term error signal component. The short-term error signal component and the long-term error signal component are then combined to result in a position error signal that is used as a feed back for the closed loop control system.

In the preferred embodiment of the present invention, the strip material includes an encoder pattern printed on the strip material and the detecting means includes an illuminator and a sensor to track the encoder pattern of the strip material to provide the microprocessor with the detecting encoder signal.

One advantage of the present invention is that the position error signal has improved accuracy over both the low frequency and the high frequency ranges because the short term accuracy of the friction wheels and the long term accuracy of the longitudinal feed provide highly reliable signals under all feed conditions.

Another advantage of the present invention is that the actual longitudinal position of the strip material is compared with the commanded position of the strip material.

The foregoing and other advantages of the present invention become more apparent in light of the following detailed description of the exemplary embodiments thereof, as illustrated in the accompanying drawings.

DETAILED DESCRIPTION OF THE INVENTION

Figure 1:
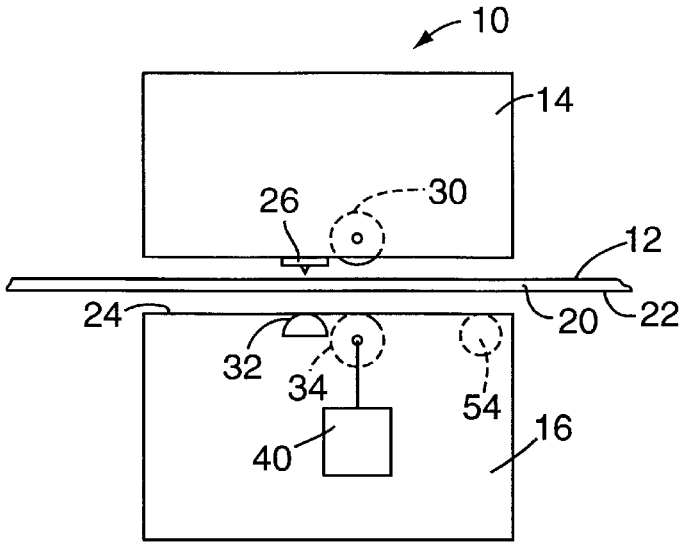
FIG. 1 is an exploded, side elevational view schematically showing a friction drive apparatus.
Figure 2:
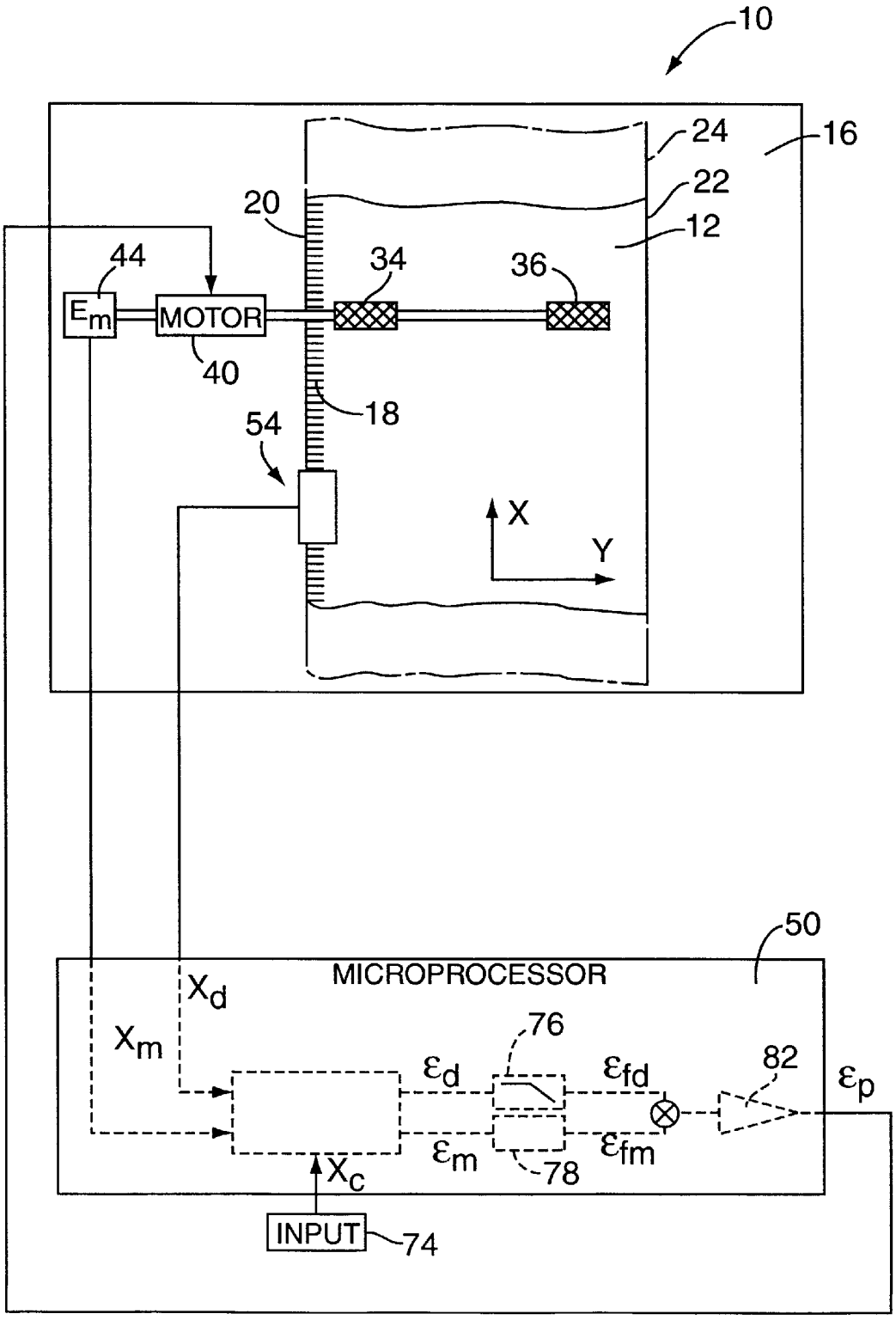
FIG. 2 is a top plan view of a base assembly of the friction drive apparatus of FIG. 1 with the strip material shown in phantom and schematically illustrating the closed loop control system with a position error signal being fed back to a drive motor.

Referring to FIG. 1, an apparatus 10 for plotting, printing, or cutting strip material 12 includes a cover assembly 14 and a base assembly 16. The strip material 12 includes an encoder pattern 18 and a pair of longitudinal edges 20, 22, as best seen in FIG. 2. The strip material is moving in a longitudinal or X-coordinate direction along a feed path 24.

The top portion 14 of the apparatus 10 includes a tool head 26 movable in a lateral or Y-coordinate direction, substantially perpendicular to the longitudinal or X-coordinate direction and the feed path 24. The cover assembly 14 also includes a plurality of pinch rollers 30 that are disposed along the longitudinal edges 20, 22 of the strip material 12. The base assembly 16 of the apparatus 10 includes a stationary or roller platen 32, disposed in register with the tool head 26, and a plurality of friction wheels 34, 36, disposed in register with the corresponding plurality of pinch rollers 30.

Referring to FIG. 2, each friction wheel 34, 36 has a surface for engaging the strip material 12, and is driven by a motor drive 40. The motor drive 40 may be a servo-motor with a drive shaft being connected to a motor encoder 44 for detecting rotational movement thereof. A motor encoder signal $x_m$ from the motor encoder 44 is communicated to a microprocessor 50.

Figure 3:
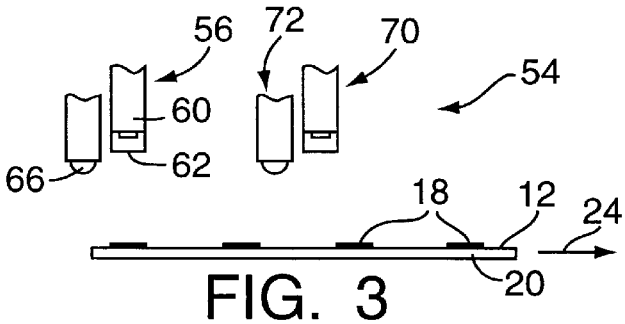
FIG. 3 is an enlarged, schematic side view of the strip material of FIG. 2 with a detecting means tracking an encoder pattern printed on the strip material.

The apparatus 10 also includes a detecting means 54 for tracking an actual longitudinal position of the strip material 12. The detecting means 54, in the preferred embodiment of the present invention, includes a first illuminator 56 which can be a laser diode 60 with a lens 62 for emitting and focusing a light beam onto the encoder pattern 18 and a first optical sensor 64, such as a photo diode 66, for sensing the encoder pattern 18, as shown in FIG. 3. The detecting means 54 in the preferred embodiment also includes a second illuminator 70 and a second optical sensor 72 spaced approximately ninety degrees (90°) out of phase with the first illuminator 56 and first optical sensor 64. A detecting encoder signal $x_d$ from the optical sensors 64, 72 of the detecting means 54 is communicated to the microprocessor 50, as shown in FIG. 2.

In operation, the drive motor 40 rotates the friction wheels 34, 36 which together with the pinch rollers 30 engage the strip material 12 to advance it back and forth along the feed path 24 in the longitudinal or X-coordinate direction, as shown in FIG. 1. As the strip material 12 moves in the longitudinal or X-coordinate direction, the tool head 26 moves in a lateral or Y-direction, either plotting, printing, or cutting the strip material depending on the specific type of tool employed. As the motor drive 40 rotates the friction wheels 34, 36, the motor encoder 44 tracks the rotational movement of the drive motor 40 and sends the motor encoder signal $x_m$ to the microprocessor 50, as best seen in FIG. 2.

Figure 4:
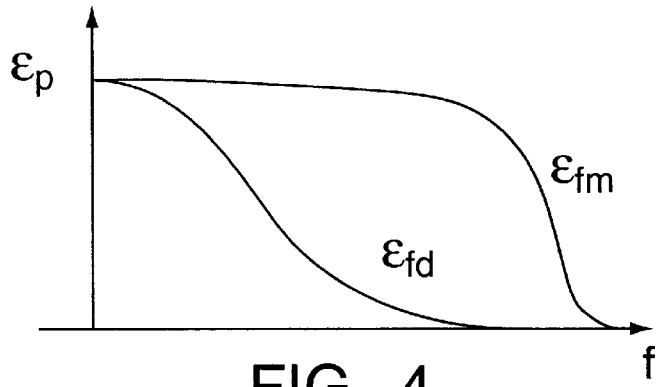
FIG. 4 is a graph showing the response curves of a low pass and an all pass filters for the friction drive apparatus of FIG. 2.

As the strip material is fed along the feed path 24, the detecting means 54 reads the encoder pattern 18 on the strip material 12 to track the actual longitudinal position of the strip material 12 in the X-coordinate direction. The optical sensors 64, 72 read the encoder pattern 18 to result in a logic-readable encoder information, such as, for example, a quad b encoder signals. These signals are then communicated to the microprocessor 50. The microprocessor 50 receives the two position signals $x_m$, $x_d$, one from the motor encoder 44 and one from the detecting means 54, conveying data regarding the motor position and the actual longitudinal position of the strip material 12, respectively. The microprocessor 50 then compares each position signal $x_m$, $x_d$ with the commanded longitudinal position input $x_c$ from input 74. The comparison between the motor encoder signal $x_m$ and the commanded position $x_c$ yields a potential discrepancy between the two signals expressed as a first error signal $\epsilon_m$. Comparison between the detecting encoder signal $x_d$ and the commanded position $x_c$ yields a second error signal $\epsilon_d$. The error signals $\epsilon_d$ and $\epsilon_m$ are then filtered through low and all pass filters 76, 78, respectively, which can be internal to the microprocessor 50. The low pass filter 76 removes high frequencies from the detecting encoder error signal $\epsilon_d$ and allows low frequencies to pass through. The filtered signals $\epsilon_{fm}$ and $\epsilon_{fd}$ are combined, as best seen in FIG. 4, and further processed, if necessary, by means of an amplifier 82 to define a single actual longitudinal position error signal $\epsilon_p$ that is fed back to drive motor 40 to complete a closed loop feedback system. The position error signal $\epsilon_p$ is added to correct the longitudinal position gradually without ruining the final product.

Figure 5:
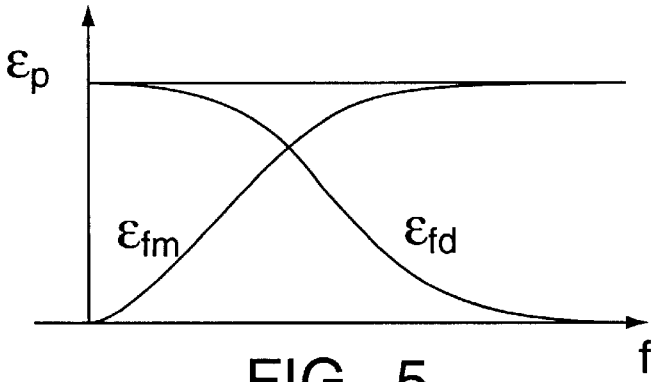
FIG. 5 is a graph showing the response curves of a low pass and a high pass filters for the friction drive apparatus of FIG. 2.

Alternatively, the all pass filter 78 can be eliminated, thereby combining the filtered detecting encoder position error signal $\epsilon_{fd}$ with the motor encoder position error signal $\epsilon_m$ to result in the longitudinal position error signal $\epsilon_p$. Additionally, the all pass filter can be replaced with a high pass filter to remove low frequencies from the motor encoder error signal $\epsilon_m$ and allow high frequencies to pass through as the filtered motor encoder position error signal $\epsilon_{fm}$, as shown in FIG. 5.

The longitudinal position error signal $\epsilon_p$ fed to the motor is accurate over both the low and high frequencies, and therefore provides motor feedback response accurate over the long-term and short-term strip material positions. The present invention maximizes the accuracy of each error signal $\epsilon_{fm}$ and $\epsilon_{fd}$ to achieve greater accuracy in determining the actual longitudinal position of the strip material. The motor encoder signal $x_m$ is much more accurate for instantaneous displacements of the strip material 12 driven by the drive motor 40. However, over the long-term, the accuracy of the motor encoder signal $x_m$ decreases because in the long-term, the strip material may slip relative to the friction wheels 34, 36 driven by the drive motor 40, thereby resulting in a discrepancy between the motor encoder reading and the actual position of the strip material. Therefore, the error $\epsilon_m$ resulting from the difference between the motor encoder position signal $x_m$ and commanded position signal $x_c$ is used to provide short-term displacement of the strip material.

Additionally, the detecting encoder signal $x_d$ provides greater accuracy over the long-term as the detection means 54 tracks the movement of the strip material 12. Once the two filtered signals are combined, as shown in FIGS. 2, 4 and 5, the resulting position error $\epsilon_p$ accurately tracks both the short-term transient movement of the strip material and the long-term large scale movements thereof and has greater accuracy over both, high and low frequencies.

Figure 6:
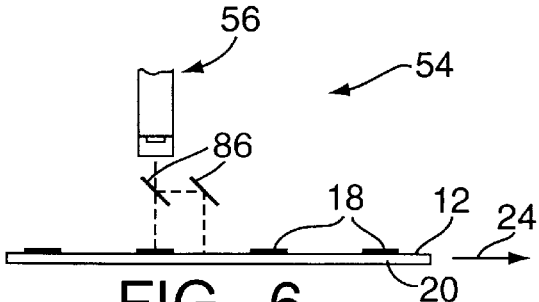
FIG. 6 is an enlarged, schematic side view of the strip material of FIG. 2 with the detecting means tracking an encoder track printed on the strip material, according to another embodiment of the present invention.
Figure 7:
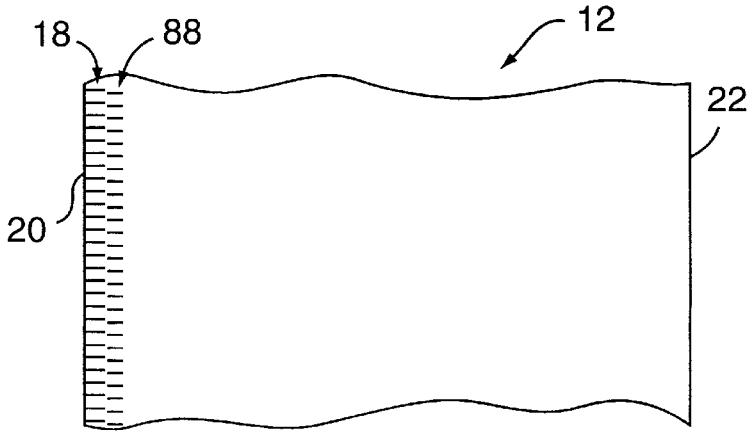
FIG. 7 is an enlarged, schematic plan view of the strip material of FIG. 2 with the encoder pattern printed thereon, according to another embodiment of the present invention.

Referring to FIG. 6, in one alternate embodiment of the present invention, only one illuminator 56 is used with a plurality of reflectors 86 to produce a second beam image on the encoder track 18. Referring to FIG. 7, in another embodiment of the present invention, a second encoder pattern 88 is printed on the strip material 12 with a ninety degree (90°) spacing or one quarter (¼) line spatial spacing with respect to the first encoder pattern 18.

Figure 8:
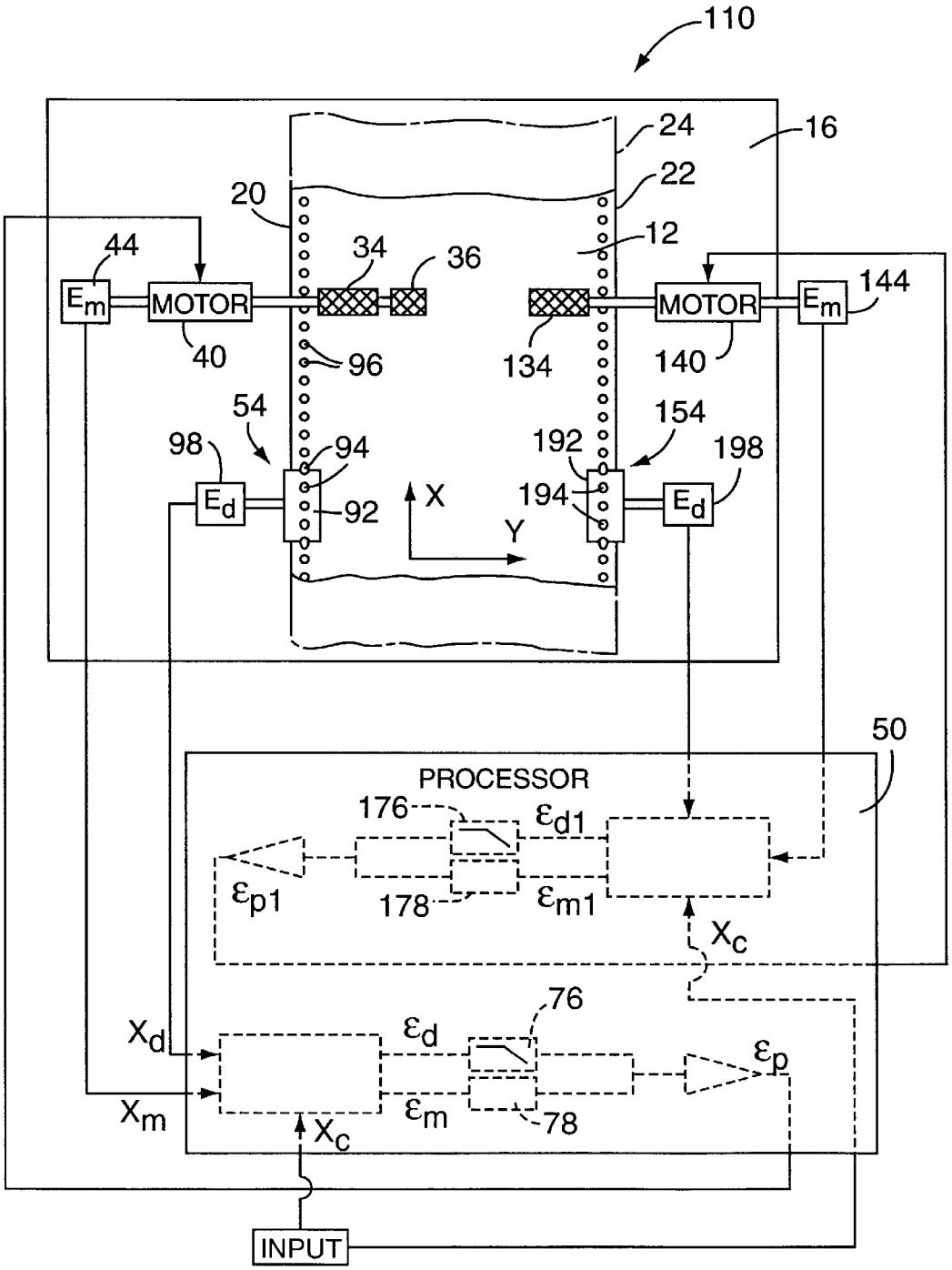
FIG. 8 is a top plan view of a base assembly of the friction drive apparatus of FIG. 1 with the strip material shown in phantom and of the control system, according to a further embodiment of the present invention.

Referring to FIG. 8, in a further embodiment of the present invention, the detecting means 54 is a free running sprocket wheel 92 to accommodate perforated strip material. The sprocket wheel 92, including a plurality of pins 94 to engage punched holes 96 formed in the strip material 12, is placed under the strip material so that the strip material 12 rotates the wheel as the strip material moves through the apparatus. There is no drive connected to the sprocket wheel 92, and the wheel inertia is kept very low so that the material 12 is able to rotate the wheel 92 without impeding motion due to acceleration or friction. A detecting encoder 98 tracks the rotational position of the sprocket wheel 92 and sends the detecting encoder signal $x_d$ to the microprocessor 50.

Additionally, the present invention can be implemented in a printing, plotting or cutting apparatus 110 having multiple friction wheels 34, 36, 134 being driven by multiple drive motors 40, 140, as shown in FIG. 8. In this alternate embodiment, each motor 40, 140 has a servo-loop including motor encoders (44, 144) and filters (76, 78, 176, 178) configured and operating analogously to the feedback system described above and shown in FIG. 2 except that differential command signals can be added to the longitudinal position signal $x_c$ for steering the strip material.

Use of other detecting means, such as optically readable encoders or, magnetic encoders cooperating with printed or magnetic tracks on the material, or free running pin or star wheels, is also possible.

While the present invention has been illustrated and described with respect to a particular embodiment thereof, it should be appreciated by those of ordinary skill in the art, that various modifications to this invention may be made without departing from the spirit and scope of the present invention. For example, the all pass, high pass and low pass filters are shown incorporated into the microprocessor. However, the all pass, high pass and low pass filters can be separate from the microprocessor. Also, the encoder pattern 18 can be printed on either side of the strip material or in the central portion thereof.

We claim:

1. A friction drive system for printing, plotting or cutting a graphic image on a strip material, said system comprising:

at least one drive motor for rotating a plurality of friction wheels, said plurality of friction wheels driving said strip material in a longitudinal direction;

a motor encoder cooperating with said at least one drive motor for tracking rotational movement of said at least one drive motor, said motor encoder generating a motor encoder signal;

detecting means for tracking movement of said strip material, said detecting means generating a detecting encoder signal indicative of said longitudinal position of said strip material;

means for comparing said motor encoder signal with a commanded position of said strip material and based on such comparison generating a motor encoder position error signal, said means for comparing also comparing said detecting encoder signal with said commanded position of said strip material and based on such comparison generating a detecting encoder position error signal;

means for filtering said detecting encoder position error signal to generate a filtered detecting encoder position error signal; and means for combining said filtered detecting encoder position error signal and said motor encoder position error signal to generate a combined position error signal.

2. The friction drive system according to claim 1 wherein said means for comparing is a microprocessor.

3. The friction drive system according to claim 1 wherein said means for comparing and said means for filtering are incorporated in a microprocessor.

4. The friction drive system according to claim 1 wherein said means for comparing, said means for filtering, and said means for combining are incorporated in a microprocessor.

5. The friction drive system according to claim 1 wherein said means for filtering includes a low pass filter to filter said detecting encoder position error signal.

6. The friction drive system according to claim 1 wherein said means for filtering further filters said motor encoder position error signal to generate a filtered motor encoder position error signal to be combined with said filtered detecting encoder position error signal to generate said combined position error signal.

7. The friction drive system according to claim 6 wherein said means for filtering further includes an all pass filter for filtering said motor encoder position error signal.

8. The friction drive system according to claim 6 wherein said means for filtering further includes a high pass filter for filtering said motor encoder position error signal.

9. The friction drive system according to claim 1 wherein said detecting means is a free running sprocket engaging a plurality of holes formed within said strip material.

10. The friction drive system according to claim 1 wherein said strip material includes an encoder pattern printed thereon.

11. The friction drive system according to claim 10 wherein said detecting means includes an illuminator and a sensor for tracking said encoder pattern.

12. The friction drive system according to claim 11 wherein said illuminator is a laser diode.

13. The friction drive system according to claim 11 wherein said sensor is a photo diode.

14. The friction drive system according to claim 10 wherein said detecting means includes a first illuminator and a second illuminator spaced substantially one quarter line spacing apart and a first sensor and a second sensor spaced substantially one quarter line spacing apart for tracking said encoder pattern and generating said detecting encoder signal.

15. A friction drive system for printing, plotting or cutting a graphic image on a strip material, said system comprising:

at least one drive motor for rotating a plurality of friction wheels, said plurality of friction wheels driving said strip material in a longitudinal direction;

a motor encoder cooperating with said drive motor for tracking rotational movement of said drive motor, said motor encoder generating a motor encoder signal;

detecting means for tracking movement of said strip material, said detecting means generating a detecting encoder signal indicative of said longitudinal position of said strip material;

means for comparing said motor encoder signal with a commanded position of said strip material and based on such comparison generating a motor encoder position error signal, said means for comparing also comparing said detecting encoder signal with said commanded position of said strip material and based on such comparison generating a detecting encoder position error signal;

means for filtering said detecting encoder position error signal to generate a filtered detecting encoder position error signal and for filtering said motor encoder position error signal to generate a filtered motor encoder position error signal; and means for combining said filtered detecting encoder position error signal and said filtered motor encoder position error signal to generate a combined position error signal.

16. The friction drive system according to claim 15 wherein said means for filtering includes a low pass filter to filter said detecting encoder position error signal and an all pass filter for filtering said motor encoder position error signal.

17. The friction drive system according to claim 15 wherein said means for filtering includes a low pass filter to filter said detecting encoder position error signal and a high pass filter for filtering said motor encoder position error signal.

18. The friction drive system according to claim 15 wherein said means for filtering are incorporated in a microprocessor.

19. A method for feeding a strip material through a printer, plotter or cutter apparatus, said strip material being driven in a longitudinal direction by a drive motor, said drive motor generating a drive motor signal said method comprising:

coupling a motor encoder to said drive motor to detect rotational movement of said drive motor, said motor encoder generating a motor encoder signal;

communicating said motor encoder signal to a microprocessor;

monitoring actual longitudinal motion of said strip material with detecting means;

coupling a detecting encoder to said detecting means to detect movement of said detecting means, said detecting encoder generating a detecting encoder signal;

communicating said detecting encoder signal to said microprocessor;

comparing said motor encoder signal with a commanded position of said strip material to generate a motor encoder error signal;

comparing said detecting encoder signal with said commanded position of said strip material to generate a detecting encoder error signal;

passing said detecting encoder error signal through a low pass filter to generate a filtered detecting encoder error signal;

generating an error position signal using said filtered detecting encoder error signal; and communicating said error position signal to said drive motor to minimize difference between said actual position of said strip material and said commanded position of said strip material.

20. The method according to claim 19 further including intermediate steps of:

passing said motor encoder error signal through an all pass filter to generate a filtered motor encoder error signal; and combining said filtered motor encoder error signal and said filtered detecting encoder error signal to generate said error position signal.

21. The method according to claim 19 further including intermediate steps of:

passing said motor encoder error signal through a high pass filter to generate a filtered motor encoder error signal; and combining said filtered motor encoder error signal and said filtered detecting encoder error signal to generate said error position signal.

22. A method for feeding a strip material through a printer, plotter or cutter apparatus, said strip material being driven in a longitudinal direction by a drive motor, said drive motor generating a drive motor signal said method comprising:

coupling a motor encoder to said drive motor to detect rotational movement of said drive motor, said motor encoder generating a motor encoder signal;

communicating said motor encoder signal to a microprocessor;

monitoring actual longitudinal motion of said strip material with detecting means;

coupling a detecting encoder to said detecting means to detect movement of said detecting means, said detecting encoder generating a detecting encoder signal;

communicating said detecting encoder signal to said microprocessor;

comparing said motor encoder signal with a commanded position of said strip material to generate a motor encoder error signal;

comparing said detecting encoder signal with said commanded position of said strip material to generate a detecting encoder error signal;

passing said motor encoder error signal through an all pass filter to generate a filtered motor encoder error signal;

passing said detecting encoder error signal through a low pass filter to generate a filtered detecting encoder error signal;

generating an error position signal by combining said filtered motor encoder error signal and said filtered detecting encoder error signal; and communicating said error position signal to said drive motor to minimize difference between said actual position of said strip material and said commanded position of said strip material.

* * * * *